US007823422B2

(12) United States Patent
Bextermoeller et al.

(10) Patent No.: US 7,823,422 B2
(45) Date of Patent: Nov. 2, 2010

(54) FRONT-LOADING MACHINE FOR TREATING LAUNDRY

(75) Inventors: Andreas Bextermoeller, Melle (DE); Dirk Dahlke, Rheda-Wiedenbrueck (DE); Alfons Eblenkamp, Rietberg (DE); Holger Hoppe, Beckum (DE); Hartmut Linnemann, Rheda-Wiedenbrueck (DE)

(73) Assignee: Miele & Cie. KG, Guetersloh (DE)

( * ) Notice: Subject to any disclaimer, the term of this patent is extended or adjusted under 35 U.S.C. 154(b) by 596 days.

(21) Appl. No.: 11/836,287

(22) Filed: Aug. 9, 2007

(65) Prior Publication Data

US 2008/0034810 A1 Feb. 14, 2008

(30) Foreign Application Priority Data

Aug. 14, 2006 (DE) ..... 10 2006 038 111

(51) Int. Cl.
*D06F 39/00* (2006.01)

(52) U.S. Cl. ..... 68/12.26; 68/196

(58) Field of Classification Search ..... 68/12.26, 68/12.27, 24, 196
See application file for complete search history.

(56) References Cited

U.S. PATENT DOCUMENTS

| | | | | |
|---|---|---|---|---|
| 4,623,179 | A * | 11/1986 | Davis et al. | 292/201 |
| 6,634,684 | B2 * | 10/2003 | Spiessl | 292/341.16 |
| 7,150,480 | B2 * | 12/2006 | Lafrenz | 292/201 |
| 2004/0244435 | A1 * | 12/2004 | Kim | 68/12.26 |
| 2007/0180869 | A1 * | 8/2007 | Geyer | 68/196 |

FOREIGN PATENT DOCUMENTS

| | | |
|---|---|---|
| DE | 19932141 | 1/2001 |
| WO | 0214593 | 2/2002 |

* cited by examiner

*Primary Examiner*—Joseph L Perrin
(74) *Attorney, Agent, or Firm*—Leydig, Voit & Mayer, Ltd.

(57) ABSTRACT

A front-loading machine for treating laundry includes a loading opening, a hinged door, a locking mechanism and an operating device. The loading opening is disposed on a front wall of the machine. The hinged door is receivable by a receiving area on the front wall so as to close the loading opening. The locking mechanism is configured to hold the door in a closed position. The operating device is configured to activate and deactivate the locking mechanism. The operating device includes a sensor configured to detect a contact or a contact-free incursion into a detection zone thereof. The sensor is disposed on at least one of the door and the receiving area on the front wall.

18 Claims, 4 Drawing Sheets

FRONT-LOADING MACHINE FOR TREATING LAUNDRY

Priority is claimed to German patent application DE 10 9006 038 111.47 filed Aug. 14, 2006, and which is hereby incorporated by reference herein.

The invention relates to a front-loading machine for treating laundry, such as a washing machine, a washer-dryer or a clothes dryer, having a loading opening that is located on the front wall and that can be closed by means of a hinged door, with a locking mechanism to hold the door in its closed position and with an operating device to activate and deactivate the locking mechanism.

BACKGROUND

A front-loading machine for treating laundry, having a loading opening that is located on the front wall and that can be closed by means of a hinged door, is described in German patent application DE 199 32 141 A1. With this machine for treating laundry, a door opening button is arranged in the front wall in the immediate vicinity of the hinged door in the area of the locking mechanism. In order to open the door, the user has to push the door opening button and almost simultaneously, can grip the edge of the door as it springs open, in order to subsequently open the door by means of a swiveling motion. This type of door opening appears to be quite convenient but it requires the user to execute two movements in different directions. In the first step, the button has to be pushed in towards the front wall, which corresponds to a movement that is counter to that required to open the door and then the door has to be pulled open by its edge so that the opening swiveling motion can be executed. This is a motion in a direction away from the front wall.

International patent application WO 02/14593 A2 describes a front-loading machine for treating laundry that has a large-surface door opening lever directly on the door. This door opening lever is fitted with numerous operating elements, for example, in order to set program parameters. For purposes of displaying status information, there are lighting elements on the circumferential edge of the door and on the door opening lever and these allow viewing and recognition of the status from a distance. The plurality of operating and display elements on the door opening lever entails the risk that an undesired setting is selected when the lever is actuated, for instance, if an operating element for selecting a program parameter is accidentally activated.

SUMMARY

Consequently, it is an aspect of the invention to improve the operating convenience of a front-loading machine for treating laundry such as a washing machine, a washer-dryer or a clothes dryer.

In an embodiment, the present invention provides a front-loading machine for treating laundry. The front-loading machine includes a loading opening, a hinged door, a locking mechanism and an operating device. The loading opening is disposed on a front wall of the machine. The hinged door is receivable by a receiving area on the front wall so as to close the loading opening. The locking mechanism is configured to hold the door in a closed position. The operating device is configured to activate and deactivate the locking mechanism. The operating device includes a sensor configured to detect a contact or a contact-free incursion into a detection zone thereof. The sensor is disposed on at least one of the door and the receiving area on the front wall.

BRIEF DESCRIPTION OF THE DRAWINGS

Exemplary embodiments of the invention are shown schematically in the drawings and described in greater detail below. The following are shown.

DETAILED DESCRIPTION

Figure 1:
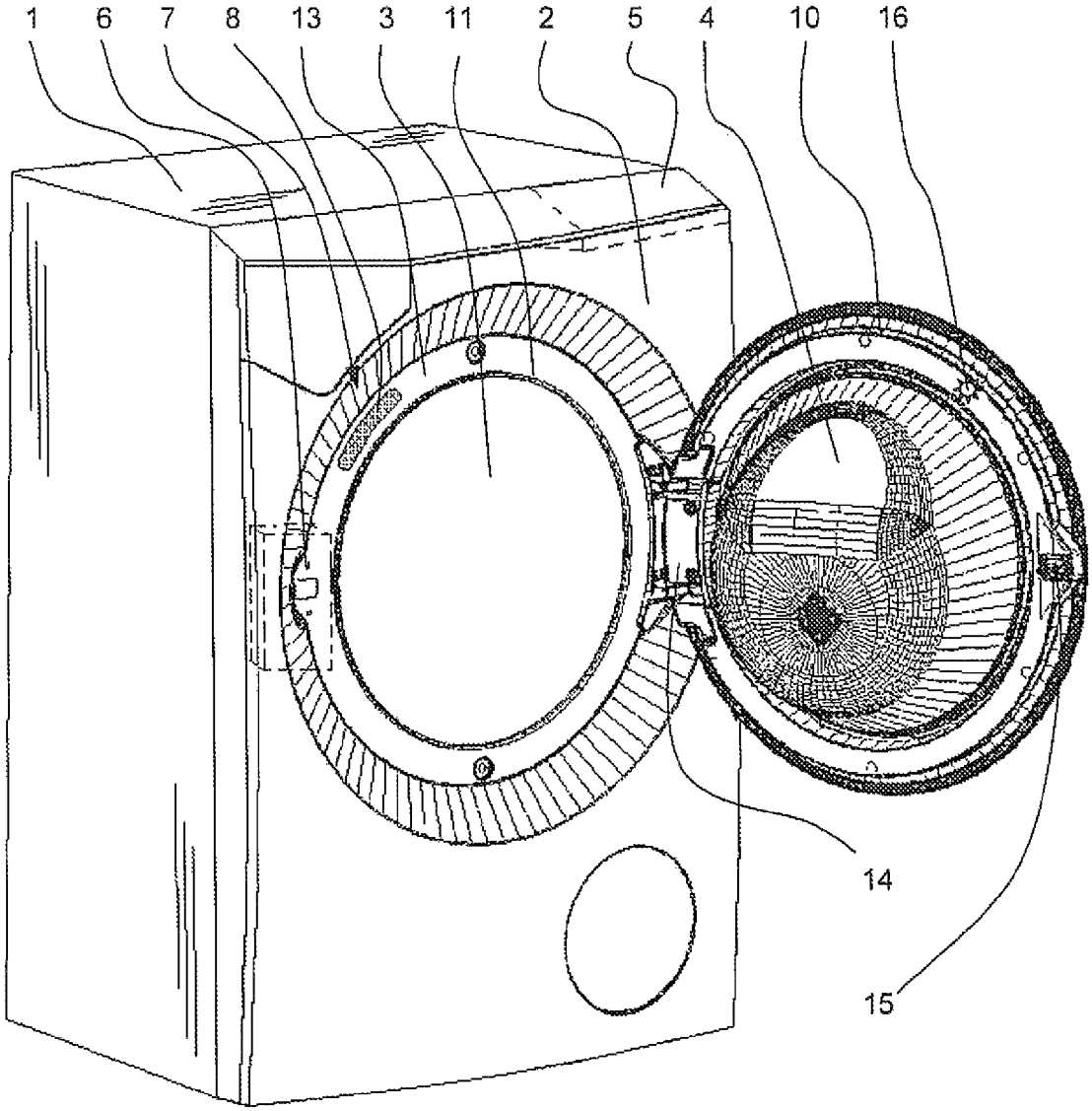
FIGS. 1, 2—a front-loading machine for treating laundry, in a perspective view.

An advantage that can be achieved with the invention is that it provides easy and convenient handling during the door opening procedure. This is attained in that the actuation device comprises at least one sensor with which contact or a contact-free incursion into its detection zone can be ascertained, whereby the at least one sensor is arranged on the door itself or on the front wall in the receiving area of the door. When the user reaches for the edge of the door, his hand enters the detection zone of the sensor, as a result of which the control device receives a signal that causes the deactivation of the locking mechanism. The user does not have to apply any force to pull the door out of its latched position or actuate a handle in order to deactivate the locking mechanism or to unlock the door.

In an embodiment, the detection zone of the at least one sensor is situated in a circumferential segment of the door or of the edge of the loading opening, said detection zone being located at an angle near the top or in a top position of the door or of the loading opening when the household appliance is in its normal operating position. In this position, the edge of the door is particularly easy to reach. When a hand is placed on the edge of the door or when there is a contact-free incursion behind the edge of the door, it is automatically unlocked and moves towards the hand being used. Then, the door can be swung open without the need to grip or pay attention to operating handles.

In an embodiment, a capacitive sensor is employed as the sensor which recognizes when contact is made, for instance, by the user, and generates a signal to deactivate the locking mechanism. This sensor provides a detection zone that is clearly delineated.

In this embodiment, it is advantageous for the capacitive sensor to be arranged on or in the door in the area of the door edge. During the actuation, the user grips the edge of the door, as a result of which the sensor is touched at that time.

In another embodiment, an optical sensor is employed as the sensor. When the hand enters the detection zone of the sensor located between the edge of the door and the front wall, a change in the light that enters the sensor is detected, in response to which a signal is generated to deactivate the locking mechanism. This sensor provides a fast response and causes the door to spring open of its own accord.

In an embodiment, at least one lighting element is arranged on the edge of the door on the side facing the front wall, said lighting, element essentially directing light to the detection zone of the sensor. In this manner, it is indicated to the user in a very precise and clear way where he has to grip the door in order to open it. Here, it is practical if the lighting element can be activated by the control device. With this approach, the lighting element can be controlled as a function of the program cycle, whereby the lighting element is switched off whenever it is not permissible to open the door. The lighting element is only switched on, for example, when a program cycle has ended and the user is prompted to remove the treated laundry from the machine for treating laundry.

In an embodiment, the at least one lighting element is arranged in a circumferential segment of the edge of the loading openings said lighting element essentially directing light to the detection zone of the sensor. The mode of operation is the same as described above, except that the light is guided to the sensor through reflection on the inner edge of the door. The components connected to the control device, such as the sensor and the lighting element, are arranged on or in the front wall. The door is free of these components, so that there is no need to create signal connections from the control device arranged in the appliance to the movable door.

In an embodiment, the optical sensor is situated on the front wall in the receiving area of the door, in a partial circumference around the loading opening. Here, the lighting element can be employed to activate the optical sensor since, when the door is gripped in the gap between the edge of the door, which contains the lighting element, and the front wall, the light beam is interrupted or a reduction occurs in the intensity of the light that acts upon the optical sensor.

The front-loading machine 1 for treating laundry shown in FIG. 1 has in its front wall 2*a* loading opening 3 that can be closed by means of a door 4, a porthole door in the embodiment shown. The door 4 is attached to the front wall 2 by means of a hinge 14. A closing element 15 that is held in the closed state by the locking mechanism 6 on the front wall 2 is arranged on the edge of the door 4. In the closed state, the door 4 is in a somewhat recessed receiving area 13 on the front wall 2, whereby an accessible gap 18 is provided between the front wall 2 and the edge 10 or the frame of the door 4. In the upper section of the receiving area 13, a sensor 8 is arranged as the operating device 7 for the locking mechanism 6, said sensor causing the door 4 to be unlocked by deactivating the locking mechanism 6 when something enters the detection zone.

The sensor 8 is activated by the control device 5 as soon as it is permissible for the door 4 to be released and opened. As a rule, this is done as a function of the cycle in the treatment program that has been selected, for instance, a washing program, which is likewise controlled and regulated by the control device 5. At the edge of the door 4 on the side facing the front wall 2, there is at least one lighting element 16 which can likewise be controlled or switched by the control device 5. It is also possible to activate the sensor 8 and/or the lighting element 16 by means of the locking mechanism 6, so that the control device 5 only has to control or switch the locking mechanism 6 as a function of the cycle in a treatment program.

According to FIG. 1, in an advantageous embodiment, the sensor 8 can be configured as a combination component with an additional or integrated lighting element, for instance, an LED. Then the lighting element 16 shown in the door 4 can be dispensed with, so that all of the components that are connected to the control device 5 or to the locking mechanism 6 are arranged in the machine 1 for treating laundry.

Figure 2:
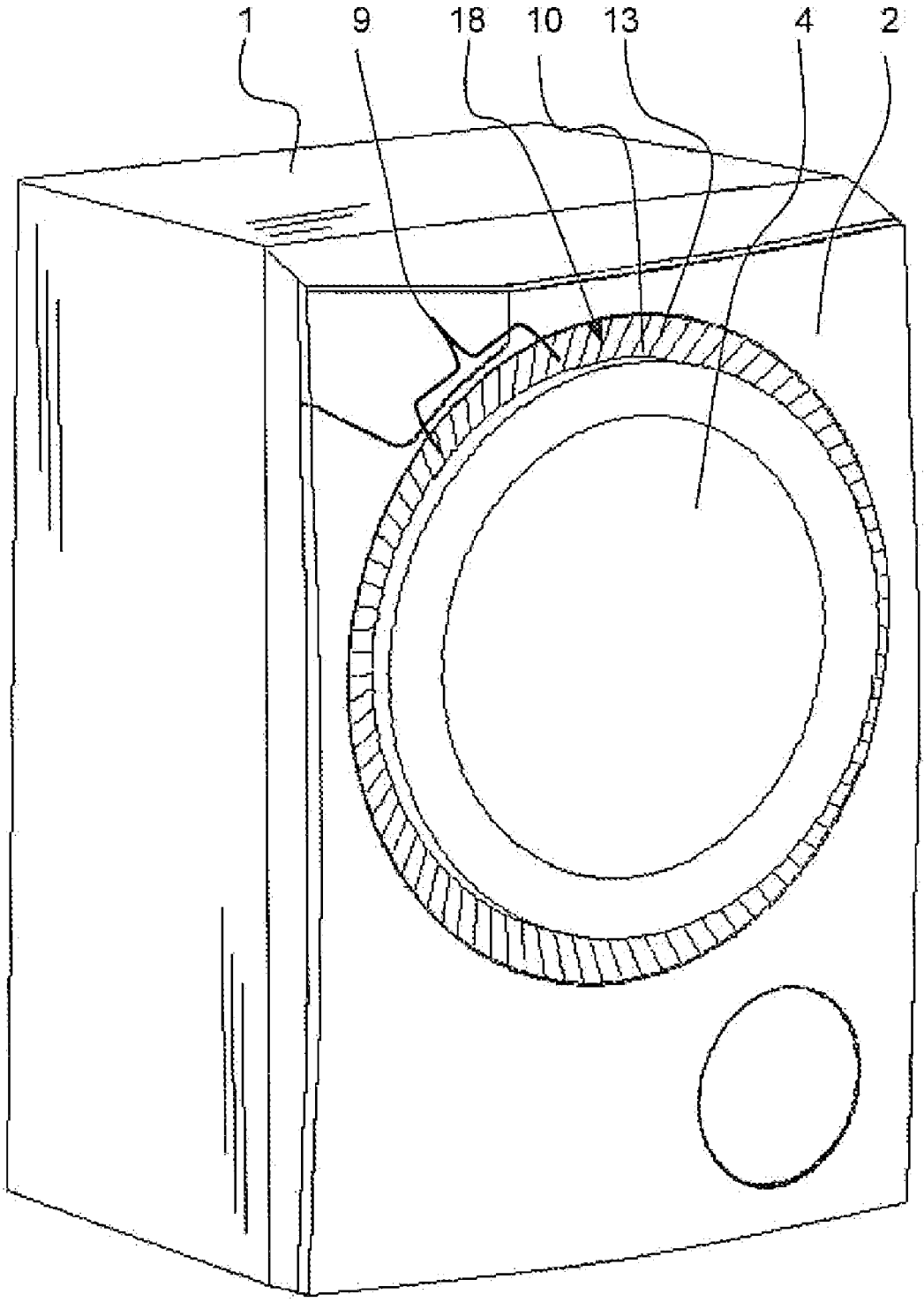

FIG. 2 shows the front-loading machine 1 for treating laundry with its door 4 closed. The edge 10 of the door 4 is in the receiving area 13 on the front wall 2, whereby a gap 18 is provided between the front wall 2 and the inside of the door edge 10. The detection zone 9 of the sensor 8 (FIG. 1) is limited to a partial circumference 12 of the door 4 or of the opening edge 11. Moreover, the detection zone 9 is essentially only active within the gap 13, thereby preventing that manipulations on the outside of the door 4 or the approach by the user towards the machine 1 for treating laundry lead to an undesired actuation of the locking mechanism 6 or to the opening of the door 4.

Figure 3:
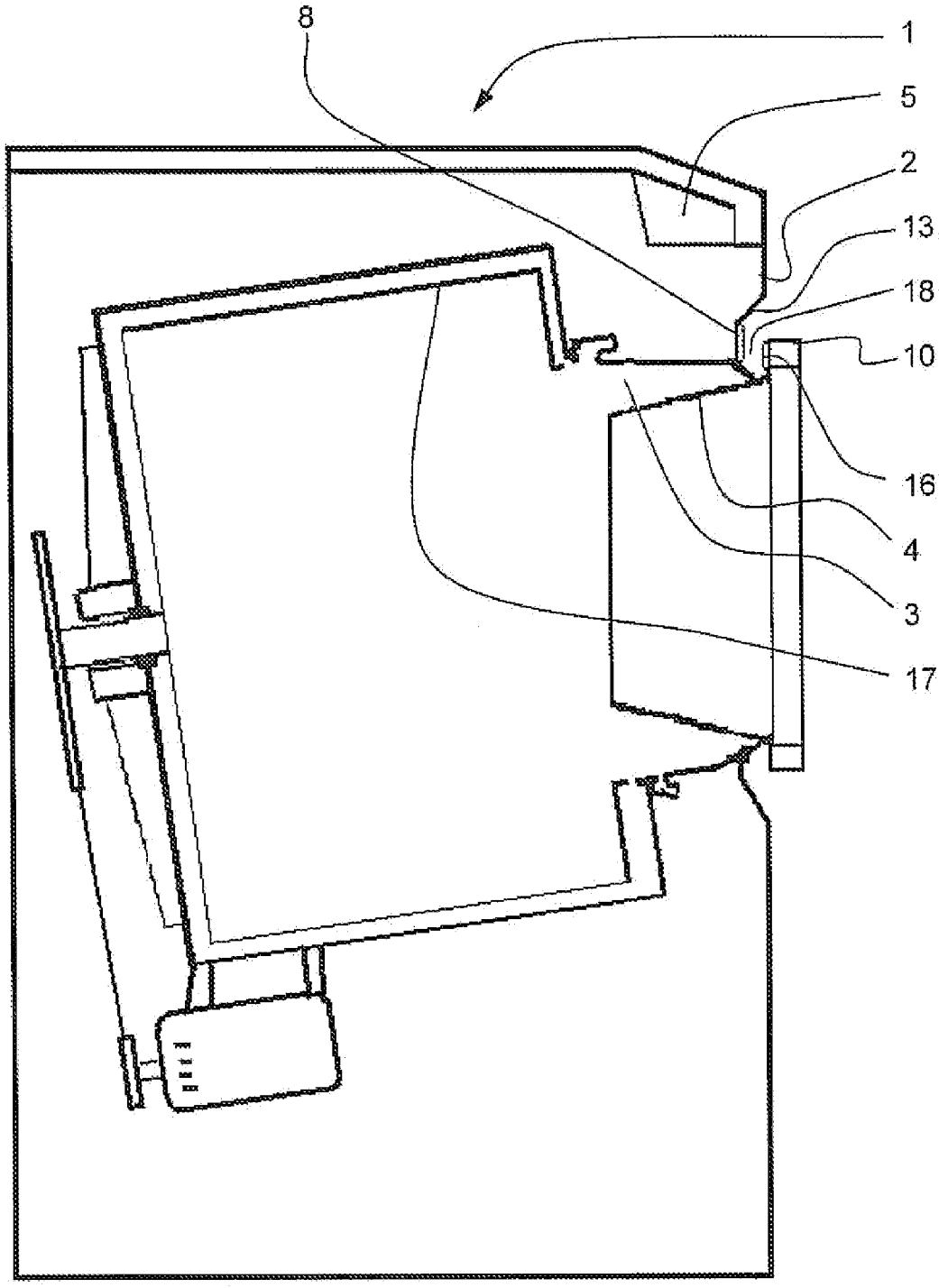
FIG. 3—a front-loading machine for treating laundry, in a schematic sectional view, and FIG. 4—a detailed view of an embodiment.

FIG. 3 schematically shows the machine 1 for treating laundry in a sectional view. The loading opening 3 for the drum 17 is closed on the front wall 2 by the door 4. The edge 10 of the door 4 lies in the receiving area 13 on the front wall 2, whereby a gap 18 remains between the front wall 2 and the inside of the door edge 10. The sensor 9 is arranged in the receiving area 13, as a result of which the detection zone 9 of the sensor 8 is limited to the gap 18. On the inside of the door edge 10, at least one lighting element 16 is arranged in the detection zone 9 of the sensor 8, said lighting element at least partially illuminating the circumference of the visible gap 18 or of the receiving area 13 of the door 4.

Figure 4:
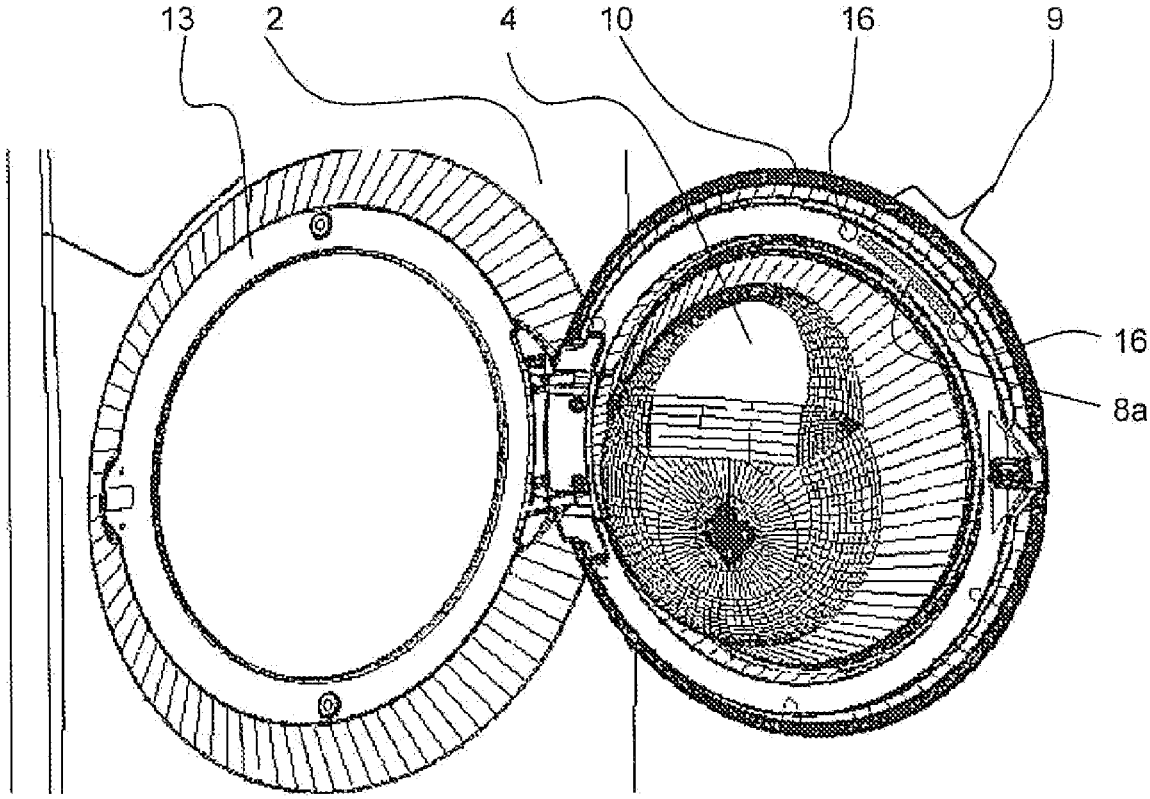

According to FIG. 4, the machine 1 for treating laundry is equipped with a capacitive sensor 8*a*. Here, the sensor 8*a* is arranged in the edge 10 of the door 4, so that a detection zone 9 limited to the circumference of the door 4 is provided. The lighting element or elements 16 is/are likewise arranged in the edge area 10 of the door 4, as a result of which the detection zone 9 on the front wall 2 or on the receiving area 13 is indirectly illuminated when the sensor 8*a* is activated.

According to FIG. 4, an optical sensor 8*a* can be employed as an alternative, so that there is no need for any components on or in the front wall 2 in the receiving area 13 of the door 4. In this embodiment, the light emitted by the lighting element 16 when the door 4 is closed strikes the front wall 2 or the receiving area 13 and illuminates the latter at least partially. The reflected light partially reaches the sensor 8*a*, said light being interrupted at least partially in response to the gripping, as a result of which the sensor 8*a* detects a change in the light intensity and causes the opening or a deactivation of the locking mechanism 6.

The present invention is not limited to the exemplary embodiments described herein.

What is claimed is:

1. A front-loading machine for treating laundry, comprising:

a loading opening disposed on a front wall of the machine;

a hinged door receivable by a receiving area on the front wall so as to close the loading opening;

a locking mechanism configured to hold the door in a closed position;

an operating device configured to activate and deactivate the locking mechanism, the operating device including a sensor configured to detect a contact or a contact-free incursion into a detection zone thereof, the sensor being disposed on at least one of the door and the receiving area on the front wall; and a lighting element disposed on an edge of the door on a side thereof facing the front wall, the lighting element being configured to direct light to the detection zone of the sensor, the lighting element being activatable by a control device of the machine.

2. The front-loading machine as recited in claim 1 comprising at least one of a washing machine, a washer-dryer and a clothes dryer.

3. The front-loading machine as recited in claim 1 wherein the detection zone of the sensor is disposed in at least one of a circumferential segment of the door and an edge of the loading opening, the detection zone being disposed at an angle near at least one of a top of the door and a top of the edge of the loading opening in a normal operating position of the front-loading machine.

4. The front-loading machine as recited in claim 3 wherein the sensor includes a capacitive sensor.

5. The front-loading machine as recited in claim 3 wherein the sensor includes an optical sensor.

6. The front-loading machine as recited in claim 1 wherein the sensor includes a capacitive sensor.

7. The front-loading machine as recited in claim 6 wherein the capacitive sensor is disposed on the door in an area of an edge of the door.

8. The front-loading machine as recited in claim 1 wherein the sensor includes an optical sensor.

9. The front-loading machine as recited in claim 8 wherein the optical sensor is disposed in the receiving area on the front wall in a partial circumference around an edge of the loading opening.

10. A front-loading machine for treating laundry, comprising:

a loading opening disposed on a front wall of the machine;

a hinged door receivable by a receiving area on the front wall so as to close the loading opening;

a locking mechanism configured to hold the door in a closed position;

an operating device configured to activate and deactivate the locking mechanism, the operating device including a sensor configured to detect a contact or a contact-free incursion into a detection zone thereof, the sensor being disposed on at least one of the door and the receiving area on the front wall; and a lighting element disposed in a circumferential segment of an edge of the loading opening, the lighting element being configured to direct light to the detection zone of the sensor, the lighting element being activatable by a control device of the machine.

11. The front-loading machine as recited in claim 10 comprising at least one of a washing machine, a washer-dryer and a clothes dryer.

12. The front-loading machine as recited in claim 10 wherein the detection zone of the sensor is disposed in at least one of a circumferential segment of the door and an edge of the loading opening, the detection zone being disposed at an angle near at least one of a top of the door and a top of the edge of the loading opening in a normal operating position of the front-loading machine.

13. The front-loading machine as recited in claim 12 wherein the sensor includes a capacitive sensor.

14. The front-loading machine as recited in claim 12 wherein the sensor includes an optical sensor.

15. The front-loading machine as recited in claim 10 wherein the sensor includes a capacitive sensor.

16. The front-loading machine as recited in claim 15 wherein the capacitive sensor is disposed on the door in an area of an edge of the door.

17. The front-loading machine as recited in claim 10 wherein the sensor includes an optical sensor.

18. The front-loading machine as recited in claim 17 wherein the optical sensor is disposed in the receiving area on the front wall in a partial circumference around an edge of the loading opening.

* * * * *